US006581850B1

(12) United States Patent
Boecking et al.

(10) Patent No.: US 6,581,850 B1
(45) Date of Patent: Jun. 24, 2003

(54) FUEL INJECTION VALVE FOR INTERNAL COMBUSTION ENGINES

(75) Inventors: Friedrich Boecking, Stuttgart (DE); Wolfgang Stoecklein, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 105 days.

(21) Appl. No.: 09/869,779

(22) PCT Filed: Nov. 10, 2000

(86) PCT No.: PCT/DE00/04011

§ 371 (c)(1),
(2), (4) Date: Sep. 6, 2001

(87) PCT Pub. No.: WO01/38712

PCT Pub. Date: May 31, 2001

(30) Foreign Application Priority Data

Nov. 11, 1999 (DE) ..... 199 54 288

(51) Int. Cl.[7] ..... B05B 1/08

(52) U.S. Cl. ..... 239/102.2; 239/239; 239/89; 239/96; 239/533.9; 239/124

(58) Field of Search ..... 239/88–93, 95, 239/96, 124–127, 533.2, 533.11, 102.2; 123/467, 472, 446, 498, 497, 496; 251/129.06, 129.15, 30.01

(56) References Cited

U.S. PATENT DOCUMENTS 5,779,149 A * 7/1998 Hayes, Jr. ..... 239/533.9
5,875,764 A * 3/1999 Kappel et al. ..... 123/467
5,893,350 A * 4/1999 Timms ..... 123/467
5,975,428 A * 11/1999 Potschin et al. ..... 239/88
6,199,533 B1 * 3/2001 Morris et al. ..... 251/129.15
6,390,066 B1 * 5/2002 Drummer et al. ..... 239/96

FOREIGN PATENT DOCUMENTS

DE 19732802 * 2/1999
DE 198 13 983 A1 9/1999
WO WO 01/29407 * 4/2001

* cited by examiner

*Primary Examiner*—Michael Mar
*Assistant Examiner*—Dinh Q Nguyen
(74) *Attorney, Agent, or Firm*—Michael J. Striker

(57) ABSTRACT

The fuel injection valve (16) has an injection valve member (24), by which at least one injection opening (26) is controlled. The motion of the injection valve member (24) is influenced by a control valve (18), which has a control valve member (62) by which the pressure in a control pressure chamber (48) is controlled and which is movable by an adjusting force generated by a piezoelectric actuator (80) and in the process control the communication of the control pressure chamber (48) with a relief chamber (12). The control valve (18) has two valve seats (60, 74), spaced apart from one another in the direction of motion of the control valve member (62), with which seats the control valve member (62) cooperates, each with a respective sealing face (66, 69) disposed on it, so that the control valve member (62) has two closing positions, in which the control pressure chamber (48) is disconnected from the relief chamber (12). When the control valve member (62) is not in one of the two closing positions, the control pressure chamber (48) does communicate with the relief chamber (12). With a motion of the control valve member (62) between its two closing positions, a brief opening of the fuel injection valve (16) is made possible.

9 Claims, 4 Drawing Sheets

FUEL INJECTION VALVE FOR INTERNAL COMBUSTION ENGINES

BACKGROUND OF THE INVENTION

The invention is based on a fuel injection valve for internal combustion engines.

One such fuel injection valve is known from German Patent Disclosure DE 198 13 983 A1. This fuel injection valve is a component of a storage-type fuel injection system and has an injection valve member by which at least one injection opening is controlled and which has a pressure shoulder defining a pressure chamber. Fuel under pressure can be delivered to the pressure chamber from a high-pressure fuel source via a pressure line, by means of which fuel the injection valve member can be lifted from a valve seat, counter to a closing force, to open the at least one injection opening. The motion of the injection valve member is influenced by a control valve, which has a control valve member that is movable by an adjusting force generated by a piezoelectric actuator and that controls the pressure, prevailing in a control pressure chamber communicating with a pressure source, which pressure urges the injection valve member in its closing direction. By means of the control valve member, the control pressure chamber can be made to communicate with a relief chamber, and as a result the pressure in the control pressure chamber drops, and the injection valve member can be moved in the opening direction. With a sealing face disposed on the control valve member, the control valve member cooperates with a valve seat. For rapid opening and closing of the fuel injection valve, as is necessary to achieve a preinjection, for instance, high adjusting forces for the control valve member are necessary and have to be generated by the piezoelectric actuator, in order to lift the control valve member from the valve seat and after its reversal of its direction of motion to return it to the valve seat again. The movement of the control valve member by the adjusting force generated by the piezoelectric actuator must furthermore be effected counter to the pressure prevailing in the control pressure chamber, so that a major force must be expended to move it. For these reasons, a piezoelectric actuator of large dimensions is required.

SUMMARY OF THE INVENTION

The fuel injection valve of the invention has the advantage over the prior art that by means of the control valve member, with a motion from one valve seat to the other, without a reversal of the direction of motion, a very rapid opening and closure of the fuel injection valve can be achieved, to which end furthermore only a slight adjusting force to be generated by the piezoelectric actuator is required, so that the piezoelectric actuator can be embodied with small dimensions.

By another embodiment it is attained that no force on the control valve member from the pressure in the control pressure chamber results, and as a result only a slight adjusting force to be generated by the piezoelectric actuator is needed to move the control valve member, and the piezoelectric actuator can be made with small dimensions. The further embodiment makes a compact structure of the control valve possible.

DESCRIPTION OF THE EXEMPLARY EMBODIMENT

Figure 1:
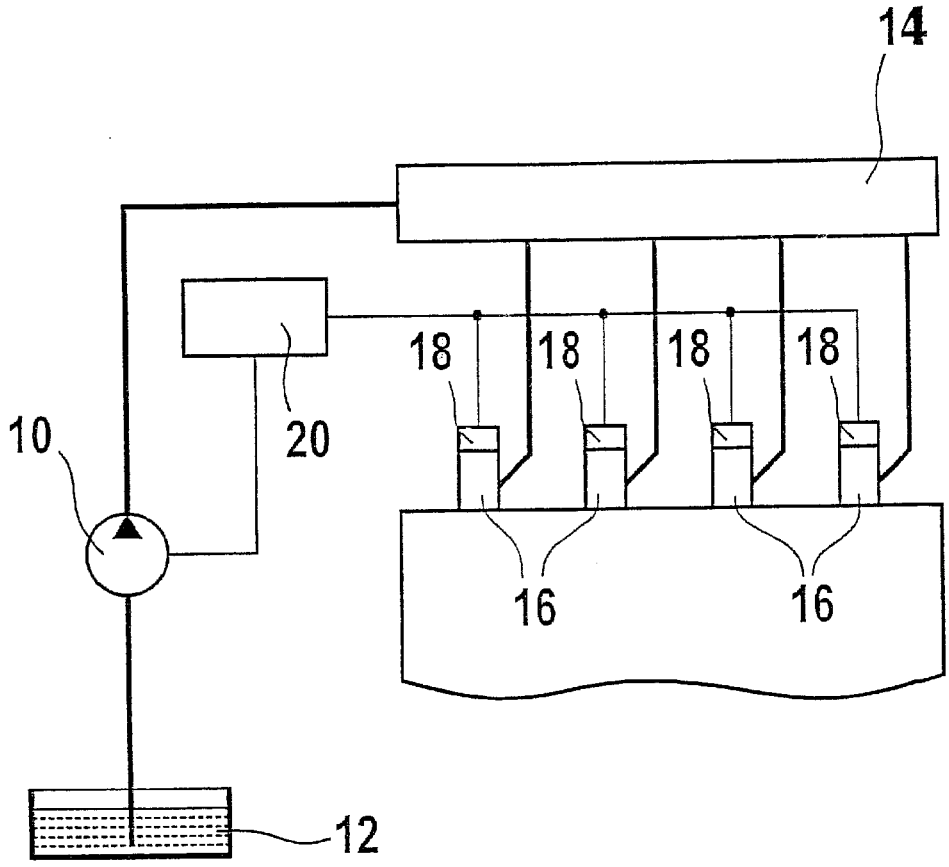
FIG. 1 shows a storage-type fuel injection system schematically.

A storage-type fuel injection system shown schematically in FIG. 1 has a high-pressure pump 10, by which fuel is pumped out of a tank 12 at high pressure into a reservoir 14. The reservoir 14 is embodied as a so-called rail, from which lines lead away to fuel injection valves 16 that are disposed in an internal combustion engine. Each fuel injection valve 16 has a control valve 18, by which the opening and closing of the fuel injection valve 16 is controlled. The storage-type fuel injection system also has a control unit 20, which is supplied with signals about various engine operating parameters and by which as a function of these signals, the control valves 18 of the fuel injection valves 16 are triggered to open or close.

Figure 2:
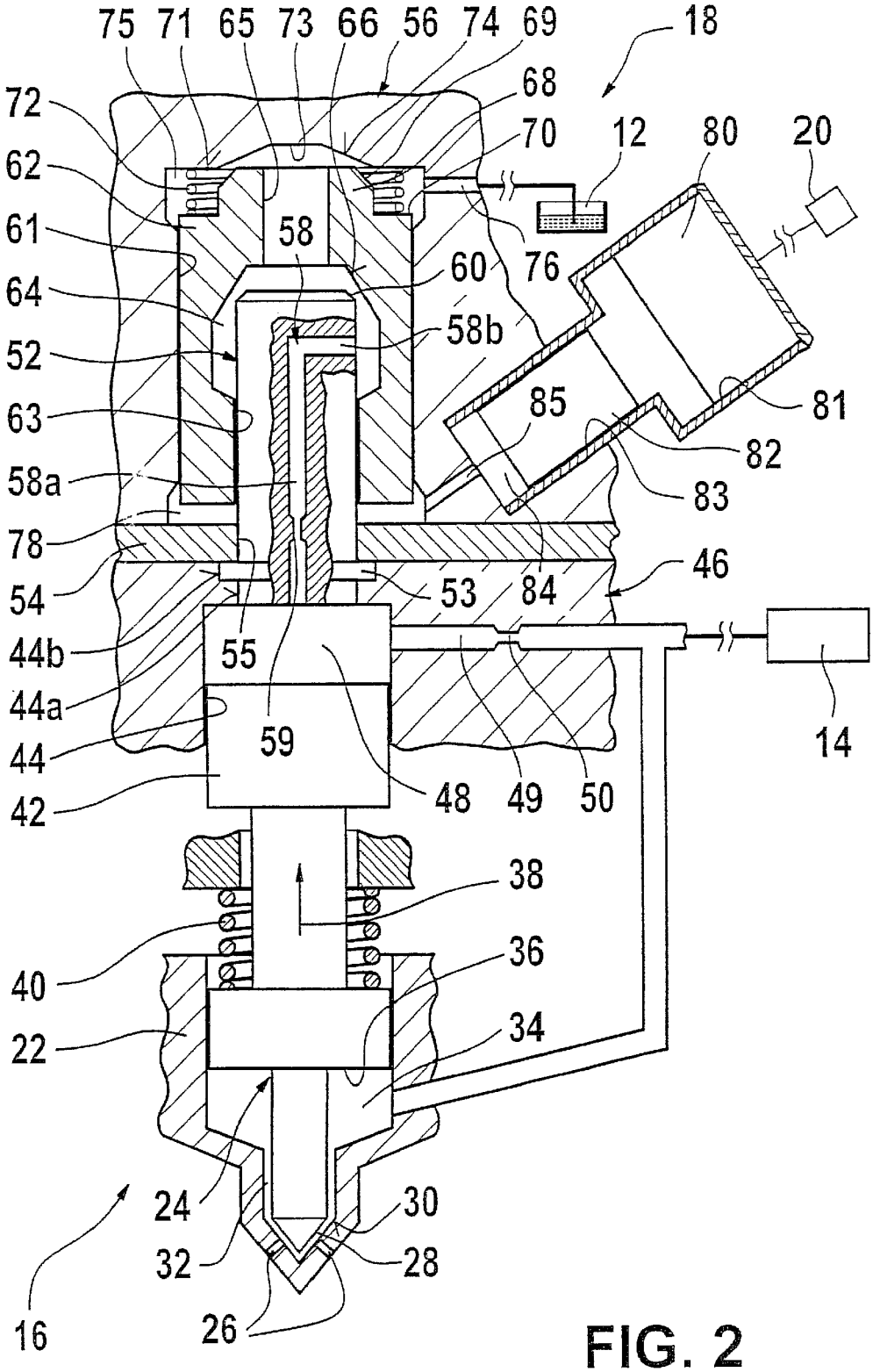
FIG. 2 shows a fuel injection valve of the storage-type fuel injection system in a longitudinal section in accordance with a first exemplary embodiment.

In FIG. 2, a fuel injection valve 16 with an associated control valve 18 is shown in a first exemplary embodiment. The fuel injection valve 16 has a valve body 22, in which an injection valve member 24 is guided axially displaceably. The valve body 22, in its end region toward the combustion chamber of the engine, has at least one and preferably a plurality of injection openings 26. In its end region toward the combustion chamber, the injection valve member 24 has a sealing face 28, for instance of conical shape, which cooperates with a valve seat 30 embodied in the valve body 22, from which valve seat the injection openings 26 lead away. In the valve body 22, an annular chamber 32 surrounding the injection valve member 24 is formed, which communicates with a pressure chamber 34 that in turn communicates with the reservoir 14, so that in the pressure chamber 34, the pressure generated by the high-pressure pump 10 prevails. The injection valve member 24 has a pressure shoulder 36, disposed in the pressure chamber 34, by way of which the pressure prevailing in the pressure chamber 34 exerts a force on the injection valve member 24 that acts in the opening direction 38 of the injection valve member. The injection valve member 24 is engaged by a prestressed closing spring 40, by means of which the injection valve member 24 is urged in the closing direction, counter to the force acting on it in the opening direction 38 as a result of the pressure prevailing in the pressure chamber 34. By the pressure prevailing in the pressure chamber 34, the injection valve member 24 is movable counter to the force of the closing spring 40 in the opening direction 38, thereby uncovering the injection openings 26, through which fuel is injected into the combustion of the engine. To terminate the injection, the injection valve member 24 is pressed in the closing direction with its sealing face 28 into the valve seat 30 on the valve body 22, so that the injection openings 26 are closed.

Disposed in the region of the end of the injection valve member 24 remote from the combustion chamber is a closing piston 42, which is part of the control valve 18. The closing piston 42 can be embodied in one piece with the injection valve member 24 or as a separate part. The closing piston 42 is disposed at least approximately coaxially to the injection valve member 24 and is guided axially displaceably in a bore 44 in a housing part 46 of the control valve 18.

In the bore 44, the closing piston 42 defines a control pressure chamber 48, which communicates with the reservoir 14 via a conduit 49 in which a throttle 50 is disposed. Remote from the closing piston 42, the bore 44 is embodied in stepped form and has one portion 44*a* of reduced diameter and adjoining it a portion 44*b* of enlarged diameter again. From the side remote from the control pressure chamber 48, a support stub 52 is inserted into the portions 44*a, b* of the bore 44; this support stub essentially has a somewhat smaller diameter than the portion 44*a* and is disposed with its end region in the portion 44*a*. The support stub 52 is disposed at least approximately coaxially to the closing piston 42. The support stub 52 has an annular collar 53, whose diameter is somewhat smaller than the diameter of the portion 44*b* of the bore 44 and which is disposed in the portion 44*b*. The support stub 52 rests with its annular collar 53 on the annular shoulder, formed at the transition between the portions 44*a* and 44*b* of the bore 44, and is thus fixed in the direction of its longitudinal axis toward the control pressure chamber 48. The housing part 46 is adjoined by a shim 54, which has a bore 55 whose diameter is greater than the diameter of the support stub 52 but less than the diameter of the annular collar 53. The shim 54 is fastened between the housing part 46 and a further housing part 56, so that by means of this shim, the support stub 52 is fixed via its annular collar 53 in the direction of its longitudinal axis away from the control pressure chamber 48 as well.

A flow conduit 58 is formed in the support stub 52, extending from the face end of the support stub 52 that defines the control pressure chamber 48 and discharging on the jacket face of the support stub 52, near the end of the support stub remote from the control pressure chamber 48. The flow conduit 58 has one portion 58*a*, originating for instance at the face end of the support stub 52 and extending approximately parallel to the longitudinal axis of the support stub 52, and a portion 58*b* that extends approximately perpendicular to the first portion and discharges at the jacket face of the support stub 52. A throttle 59 can be disposed in the flow conduit 58 in order to limit the flow. In its end region remote from the control pressure chamber 48, the support stub 52 has a chamfer 68, which for instance is conical, and which serves as a first valve seat for the control valve 18.

The housing part 56 of the control valve 18 has a bore 61, into which the support stub 52 protrudes with its region remote from the control pressure chamber 48. A control valve member 62 is guided tightly displaceably in the bore 61 and is embodied as a hollow piston into which the support stub 52 protrudes. Toward the shim 54, the control valve member 62 has a bore 63 whose diameter is only slightly larger than the diameter of the support stub 52 that passes through the bore 63. Adjoining the bore 63 in the control valve member 62 is a pressure chamber 64, which is widened relative to the bore 63 and in which the flow conduit 58 of the support stub 52 discharges. Adjoining the pressure chamber 64 in the control valve member 62 is a bore 65, of lesser diameter than the bore 63, which discharges at the face end, remote from the shim 54, of the control valve member 62. The transition from the pressure chamber 64 to the bore 65 extends with what is for instance a conical chamfer 66. The bore 63, pressure chamber 64 and bore 65 in the control valve member 62 are disposed at least approximately coaxially to one another. The chamfer 66 acts as a first sealing face of the control valve member 62, which face cooperates with the chamfer 60 on the support stub 52 as a first valve seat. The bore 65 forms an outflow conduit, by which the pressure chamber 64 communicates with the outside of the control valve member 62.

The control valve member 62, in its end region remote from the shim 54, has an extension 68 of reduced diameter compared to the diameter of the region of the control valve member 62 guided in the bore 61; the extension, toward its end, tapers with what is for instance a conical chamfer 69, which forms a second sealing face on the control valve member 62. By means of the reduced-diameter extension 68, an annular shoulder 70 is formed on the control valve member 62. The bore 61 is embodied as a blind bore, and between the bottom 71 of the bore 61 and the annular shoulder 70 of the control valve member 62 a prestressed restoring spring 72 is disposed, by which the control valve member 62 is pressed toward the shim 54. The bottom 71 of the bore 61 has an indentation 73 disposed at least approximately coaxially to the control valve member 62, and the edge 74 is embodied for instance in conically chamfered form and forms a second valve seat, with which the chamfer 69 on the control valve member 62, embodied as the second sealing face, cooperates. By means of the control valve member 62 with its extension 68, an annular chamber 75 is defined in the bore 61, which chamber communicates via a conduit 76 with a relief chamber, as which the tank 12 can for instance serve.

The diameter of the first valve seat 60 and of the second valve seat 74, on which seats the control valve member 62 comes to rest with its first sealing face 66 and its second sealing face 69, respectively, are at least approximately the same size.

A work chamber 78 is defined in the bore 61 toward the shim 54 by the control valve member 62. The bore 61 can be somewhat enlarged in diameter in the region of the annular chamber 75 and/or in the region of the work chamber 78, compared to the region in which the control valve member 62 is guided in the bore 61. The work chamber 78 communicates via a hydraulic booster with a piezoelectric actuator 80. The piezoelectric actuator 80 is triggered by the control unit 20 and changes its length as a function of an electrical voltage applied to it. The piezoelectric actuator 80 is disposed in a cylinder 81 and upon its change in length it effects a compression or decompression of a hydraulic volume disposed in the cylinder 81. The hydraulic boosting is attained in that the hydraulic volume, varied by the piezoelectric actuator 80, acts upon a piston 82 of reduced diameter compared to the piezoelectric actuator 80, which piston, upon a change in length of the piezoelectric actuator 80, executes a stroke that is increased by the proportion of the diameter of the piezoelectric actuator 80 to the diameter of the piston 82. The piston 82 is disposed at least approximately coaxially to the piezoelectric actuator 80 and is guided displaceably in a cylinder 83 of suitable diameter. By means of the piston 82, a work chamber 84 is defined which communicates with the work chamber 78 via a conduit 85 of lesser diameter in the housing part 56. The piezoelectric actuator 80 and the piston 82 can be disposed arbitrarily on the circumference of the housing part 56 of the control valve 18 and can be approximately perpendicular with their longitudinal axes to the longitudinal axis of the control valve 18 or, as shown in FIG. 2, can be inclined arbitrarily to the longitudinal axis of the control valve.

The function of the fuel injection valve 16 and the control valve 18 will now be described. When the piezoelectric actuator 80 is not activated, a low pressure prevails in the work chamber 78, and the control valve member 62 is kept with its first sealing face 66 in contact with the first valve seat 60 of the support stub 52 by means of the restoring spring. The control valve member 62 is located here in a first closing position. The pressure chamber 64 in the control valve member 62 is thus disconnected from the relief chamber, which is formed by the tank 12, and no fuel can flow out of the control pressure chamber 48 through the conduit 58 and the pressure chamber 64. For this reason, the same pressure prevails in the control pressure chamber 48 as in the reservoir 14 and acts on the closing piston 42 and by way of it on the injection valve member 24, keeping it in its closing position, in which the injection valve member 24 rests with its sealing face 28 on the valve seat 30 and closes the injection openings 28, so that no fuel is injected.

When the piezoelectric actuator 80 is triggered by the control unit 20, its length increases, and by means of the piston 82 hydraulic volume is positively displaced out of the work chamber 84 via the conduit 85 into the work chamber 78, where the pressure rises until the force exerted by it on the control valve member 62 can overcome the prestressing of the restoring spring 72, and the control valve member 62 is moved away from the shim 54. The first sealing face 66 of the control valve member 62 lifts from the first valve seat 60 on the support stub 52, so that the pressure chamber 64 communicates in the control valve member 62 with the bore 65. The second sealing face 69 on the control valve member 62 is then not yet in contact with the second valve seat 74, so that the bore 65 of the control valve member 62 communicates with the annular chamber 75 and by of it with the tank 12 acting as a relief chamber. From the control pressure chamber 48, in this open position of the control valve 18, fuel can flow out through the flow conduit 58, the pressure chamber 64 and the bore 65, serving as an outflow conduit, into the relief chamber, and as a result the pressure in the control pressure chamber 48 drops. The injection valve member 24 can in this case be moved in the opening direction 38 by the pressure of the reservoir 14 acting on its pressure shoulder 36, counter to the force of the closing spring 40 and counter to the force generated by the reduced pressure prevailing in the control pressure chamber 48, and uncovers the injection openings 28, so that fuel is injected.

If the pressure generated by the piezoelectric actuator 80 in the work chamber 78 is increased further, then the control valve member 62 is displaced farther, until it comes into contact, with its second sealing face 69, with the second valve seat 74 on the bottom 71 of the bore 61. The control valve member 62 is then in a second closing position. In that case, the bore 65 in the control valve member 62 is disconnected from the annular chamber 75, so that fuel can flow out through the bore 65 from the control valve member 62, and the high pressure of the reservoir 14 prevails in the control pressure chamber 48, by which pressure, via the closing piston 42, the injection valve member 24 is moved into its closing position and kept there.

By suitable triggering of the piezoelectric actuator 80 via the control unit 20, the pressure in the work chamber 78 can be adjusted such that the control valve 18 is kept in its open position, in which it neither rests with its first sealing face 66 on the first valve seat 60 of the support stub 52 nor with its second sealing face 69 on the second valve seat 74 on the bottom 71 of the bore 61, and thus the fuel injection valve 16 remains open. It can also be provided that by suitable activation of the piezoelectric actuator 80, the control valve member 62 moves from its first closing position to its second closing position, or vice versa, without interrupting its motion. In the motion of the control valve member 62, no reversal of the direction of motion then occurs; instead, the control valve member is moved in only one direction. The control valve 18 is opened only briefly in the process, so that correspondingly the fuel injection valve 16 is opened only briefly as well. This makes a fuel injection possible for instance in which a slight fuel quantity is injected prior to the actual fuel injection. By suitable triggering of the piezoelectric actuator 78 of the control valve 18 via the control unit 20, the instant of opening, duration of opening, and length of the opening stroke of the fuel injection valve 16 can all be determined. The fuel injection valve can initially be opened only briefly and/or with only a slight opening stroke for the preinjection and then can be closed and then opened for a longer time and/or with a longer opening stroke for the main injection. A certain course of the injection can also be attained, for instance in which the fuel injection valve is initially opened with only a short opening stroke and then with a longer opening stroke. An arbitrary other course of the injection can also be attained instead.

When the control valve member 62 is in its first closing position, in which its first sealing face 66 rests on the first valve seat 60 on the support stub 52, the pressure of the control pressure chamber 48 is operative in the pressure chamber 64, but there is no resultant force on the control valve member 62, since the pressure acts upon the pressure chamber 64 on all sides. When the control valve member 62 is in its second closing position, in which its second sealing face 69 rests on the second valve seat 74 on the bottom 71 of the bore 61, then once again there is no resultant force from the pressure of the control pressure chamber 48 prevailing in the pressure chamber 64 and in the bore 65, since the diameters of the two valve seats 60 and 74 are the same. The pressure acts on the face end of the control valve member 62, next to the bore 65, on an annular area of equal size to that inside the control valve member 62 next to the bore 65, so that the resultant pressure forces compensate for one another. A motion of the control valve member 62 by means of the pressure in the work chamber 78 generated by the piezoelectric actuator 80 therefore need not take place counter to the pressure in the control pressure chamber 48, so that only relatively slight adjusting forces have to be generated by the piezoelectric actuator 80, and both the piezoelectric actuator 80 and the hydraulic booster can be embodied with small dimensions.

Figure 3:
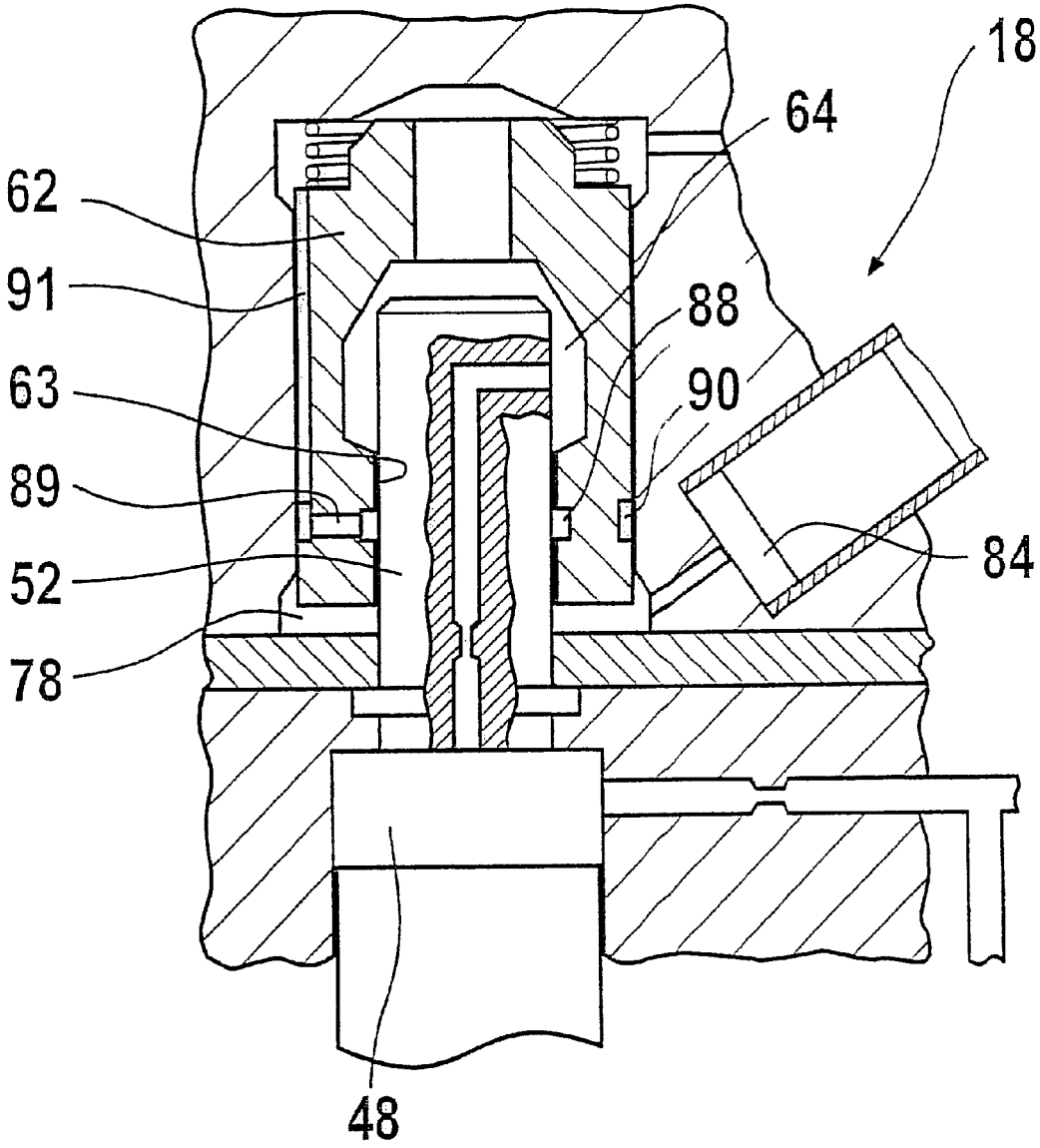
FIG. 3 shows the fuel injection valve in longitudinal section in a modified version.

In FIG. 3, the control valve 18 is shown in a version that is modified over the first exemplary embodiment explained above; here the fundamental design of the control valve 18 in the modified version is the same as in the first exemplary embodiment, and only the additional characteristics will be explained below. The support stub 52 is guided as tightly as possible in the bore 63 of the control valve member 62, so that the bore 63 represents a sealing region by which the pressure chamber 64 in the control valve member 62 is disconnected from the work chamber 78. The control valve member 62 in its bore 63 has an encompassing annular groove 88, which via one or more approximately radial bores 89 communicates with an annular groove 90 embodied in the outer jacket of the control valve member 62. From the annular groove 90, a groove 91, extending for instance approximately axially, that is embodied in the outer jacket of the control valve member 62 leads into the annular chamber 75, by way of which a communication is made with the relief chamber in the form of the tank. When the control valve member 62 is in one of its closing positions, then the same high pressure prevails in the pressure chamber 64 as in the control pressure chamber 48, and fuel possibly flows out of the pressure chamber 64 through the annular gap existing between the support stub 52 and the bore 63. This outflowing leakage quantity of fuel is removed into the relief chamber via the annular groove 88, the bore 89, the annular groove 90, and the groove 91 and cannot reach the work chamber 78. The groove 91 can also be embodied in the bore 61 of the housing part 56, instead of in the outer jacket of the control valve member 62. Via the annular grooves 88 and 90, it is also possible for the work chambers 78 and 84 of the hydraulic booster of the control valve 18 to be filled.

Figure 4:
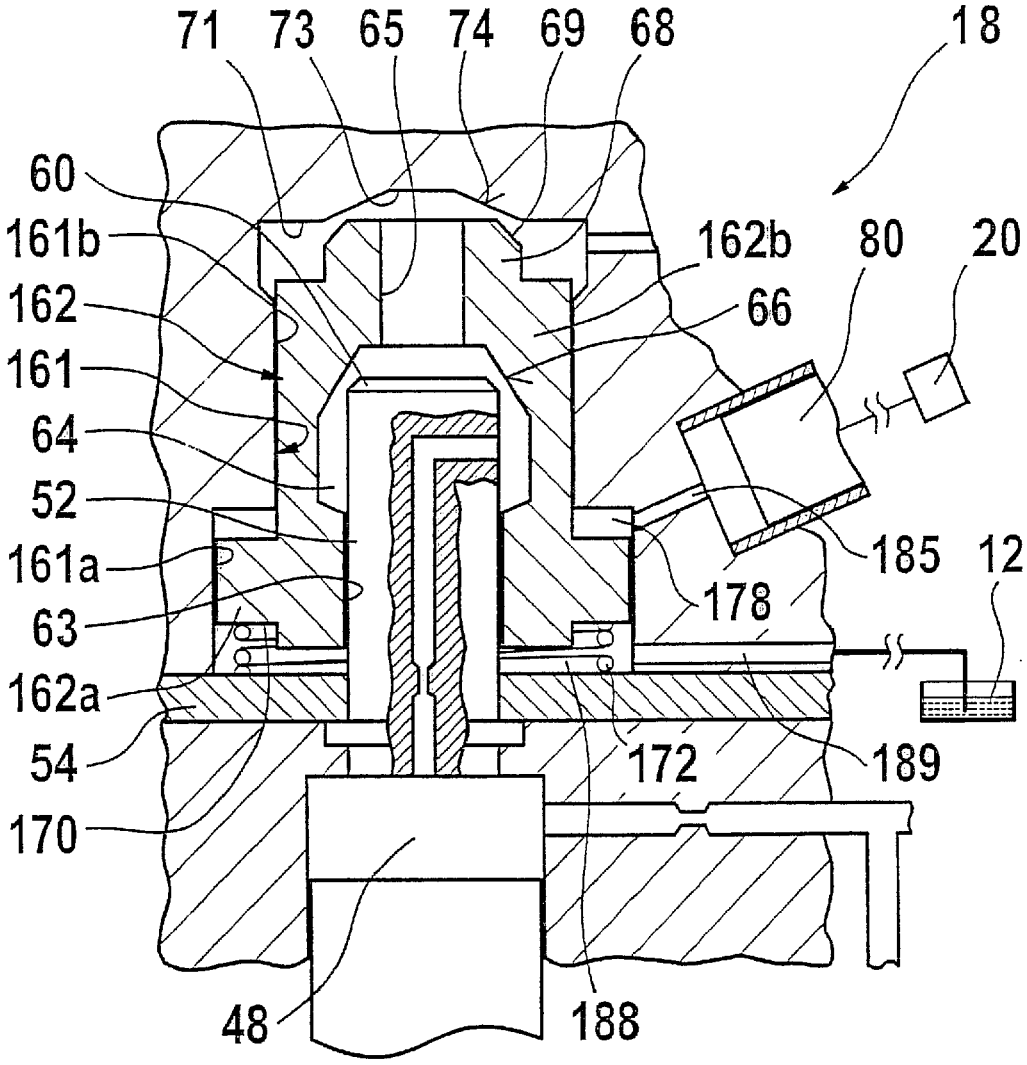
FIG. 4 shows the fuel injection valve in longitudinal section in a second exemplary embodiment.

In FIG. 4, the control valve 18 is shown in a second exemplary embodiment, in which once again the basic structure is the same as in the first exemplary embodiment, but the operative directions of the adjusting force generated by the piezoelectric actuator and of the restoring spring are reversed. The control valve member 162 has the bore 63, through which the support stub 52 protrudes into the pressure chamber 64 from which the bore 65 leads away. The indentation 73 is embodied on the bottom 71 of the bore 161, and the control valve member 162 has the extension 88. The bore 161 is embodied as a stepped bore and toward the shim 54 has a portion 161*a* of larger diameter and toward its bottom 71 a portion 161*b* of smaller diameter. The control valve member 162 is correspondingly stepped in its outer diameter as well and has a region 162*a* of larger diameter, disposed in the portion 161*a* of the bore 161, and a region 162*b* of smaller diameter, disposed in the portion 161*b* of the bore 161. Between an annular shoulder 170, formed by a step on the control valve member 162, and the shim 54, there is a prestressed restoring spring 172, by which the control valve member 162 is pressed toward the bottom 71 of the bore 161. By means of the larger-diameter region 162*a* of the control valve member 162, a work chamber 178 is defined in the portion 161*a* of the bore 161; this work chamber communicates via a conduit 185 with the hydraulic booster of the piezoelectric actuator 80. The chamber 188, in which the restoring spring 172 is disposed and which is defined toward the shim 54 by the control valve member 162 in the portion 161*a* of the bore 161, communicates via a conduit 189 with a relief chamber, for instance the tank 12.

The function of the control valve 18 in the second exemplary embodiment will now be explained. If the piezoelectric actuator 80 is not activated by the control unit 20, then by means of the restoring spring 172, the control valve member 162 is pressed with its second sealing face 69 against the second valve seat 74 on the bottom 71 of the bore and is in its second closing position. If the piezoelectric actuator 80 is activated, then by the increased pressure in the work chamber 178, the control valve member 162 is displaced toward the shim 54, counter to the prestressing of the restoring spring 172. Given adequately high pressure in the work chamber 178, the control valve member 162 comes with its first sealing face 66 into contact with the first valve seat 60 and is kept in its first closing position. In its second closing position, in which the control valve member 162 is located when the piezoelectric actuator 80 is not activated, the volume of the bore 65 in the control valve member 162 is likewise acted upon by the high pressure in the control pressure chamber 48. In contrast to this, the control valve member 62 in the first exemplary embodiment, when the piezoelectric actuator 80 is not activated, is in its first closing position, in which only the pressure chamber 64 in the control valve member 62 is acted upon by the high pressure in the control pressure chamber 48, while the volume of the bore 65 communicates with the relief chamber. Because of the greater volume, acted upon by the high pressure in the control pressure chamber 48, that is present in the control valve 18 of the second exemplary embodiment, the dynamic behavior of the control valve 18 can be varied, especially in the event of short preinjection times.

What is claimed is:

1. A fuel injection valve for internal combustion engines, in particular as a component of a storage-type fuel injection system, having an axially displaceably guided injection valve member (24), by which at least one injection opening (26) is controlled and which has a pressure shoulder (36) defining a pressure chamber (34), wherein fuel under pressure is delivered to the pressure chamber (36) from a high-pressure fuel source (10; 14), by which fuel the injection valve member (24) can be lifted from a valve seat (30) counter to a closing force to open the at least one injection opening (26), and having a control valve (18) influencing the motion of the injection valve member (24), which control valve has a control valve member (62; 162) movable counter to a restoring force by an adjusting force generated by a piezoelectric actuator (80), which control valve member controls the pressure prevailing in a control pressure chamber (48) communicating with a pressure source (10; 14), which pressure at least indirectly urges the injection valve member (24) in its closing direction, wherein by means of the control valve member (62; 162), the control pressure chamber (48) can be made to communicate with a relief chamber (12), and the control valve member (62; 162), with at least one sealing face (66, 69), cooperates with at least one valve seat (60, 74) by way of which the communication of the control pressure chamber (48) with the relief chamber (12) is controlled, characterized in that the control valve (18) has two valve seats (60, 74), spaced apart from one another in the direction of motion of the control valve member (62; 162); that the control valve member (62; 162) is movable between two closing positions, in each of which it rests with a respective sealing face (66, 69) on one of the valve seats (60, 74), and the control pressure chamber (48) is disconnected from the relief chamber (12), and that when the control valve member (62; 162) is disposed between its two closing positions, the control pressure chamber (48) communicates with the relief chamber (12).

2. The fuel injection valve of claim 1, characterized in that the two valve seats (60, 74) have at least approximately the same cross-sectional area.

3. The fuel injection valve of claim 1, characterized in that the control valve member (62; 162) is embodied as a hollow piston, and a first sealing face (66) is disposed inside the control valve member (62; 162), and a second sealing face (69) is disposed on the outside of the control valve member (62; 162).

4. The fuel injection valve of claim 3, characterized in that a support stub (52) protrudes into the control valve member (62; 162), and embodied in the support stub is a conduit (58), leading to the control pressure chamber (48), that discharges in the control valve member (62; 162) into a pressure chamber (64) whose communication with the relief chamber (12) is controlled by the control valve member (62; 162).

5. The fuel injection valve of claim 4, characterized in that the first sealing face (66), embodied inside the control valve member (62; 162), cooperates with of the support stub (52), which region acts as (60), and through this, a communication of the pressure chamber (64) with an outflow conduit (65) embodied in the control valve member (62; 162) is controlled.

6. The fuel injection valve of claim 5, characterized in that the second sealing face (69), disposed on the outside of the control valve member (62; 162), is disposed in a region of the orifice of the outflow conduit (65) and cooperates with a second valve seat (74) disposed on a housing part (56) of the control valve (16) and by means of this controls a communication of the outflow conduit (65) with the relief chamber (12).

7. The fuel injection valve of claim 6, characterized in that the control valve member (162) is urged by the restoring force toward the second valve seat (74) on the housing part (56).

8. The fuel injection valve of claim 5, characterized in that the control valve member (62) is urged by the restoring force toward the first valve seat (60) on the support stub (52).

9. The fuel injection valve of claim 4, characterized in that the adjusting force generated by the piezoelectric actuator (80) is reinforced by a hydraulic booster, which has a work chamber (78) defined by the control valve member (62); that between the support stub (52) and the control valve member (62), a sealing region (63) is provided, by which the pressure chamber (64) is disconnected from the work chamber (78); and that the sealing region (63) has a communication (88, 89, 90, 91) with the relief chamber (12).

* * * * *